United States Patent [19]

McKaig

[11] Patent Number: 4,998,700

[45] Date of Patent: Mar. 12, 1991

[54] BED SIDE RAIL HOLDING BRACKET

[76] Inventor: Phyllis J. McKaig, 1536 S. Rugby Pl., East Ridge, Tenn. 37412

[21] Appl. No.: 512,956

[22] Filed: Apr. 23, 1990

[51] Int. Cl.[5] ..... A47B 96/06

[52] U.S. Cl. ..... 248/214; 248/311.2; 5/503

[58] Field of Search ..... 248/214, 215, 230, 231.8, 248/231.7, 311.2, 315; 5/503, 508

[56] References Cited

U.S. PATENT DOCUMENTS

| | | | |
|---|---|---|---|
| 3,113,677 | 12/1963 | Johnson | 248/214 |
| 3,473,772 | 10/1969 | Nilson | 248/214 |
| 3,586,276 | 6/1971 | O'Mahoney | 5/503 X |
| 4,085,867 | 4/1978 | Heller | 248/215 X |
| 4,247,070 | 1/1981 | Dirksing | 248/215 X |
| 4,436,269 | 3/1984 | Dirksing et al. | 248/214 |
| 4,455,692 | 6/1984 | Hegge et al. | 248/214 X |
| 4,848,622 | 7/1989 | Kroetsch | 5/503 X |
| 4,945,561 | 7/1990 | Rioux, Jr. | 248/214 |

*Primary Examiner*—Gary L. Smith
*Assistant Examiner*—Michael J. Milano
*Attorney, Agent, or Firm*—Alan Ruderman

[57] ABSTRACT

A mounting bracket for supporting a shelf for holding drinking cups or the like includes a housing having a clamping slot at the top for clamping about an upper longitudinally extending rail of a bed side rail, and a clamping slot facing toward the bed in a block carried by an arm for clamping about a lower longitudinally extending rail of the bed rail. The arm is telescopically positioned within a slideway formed in the housing so as to be adjustable relative to the housing. The arm includes a multiplicity of teeth to provide positive stops for the arm as it is moved relative to the housing. A stop member at the top of the arm prevents the arm from being pulled out of the housing. The shelf is slidably removeably attached within a groove at the wall of the housing facing remotely from the bed so that shelves for holding various items can be carried selectively by the bracket.

17 Claims, 1 Drawing Sheet

BED SIDE RAIL HOLDING BRACKET

BACKGROUND OF THE INVENTION

This invention relates to a mounting bracket adapted for attachment to a bed for holding various items, and more particularly to a mounting bracket adapted to be selectively attached to the side rails of hospital beds or the like for holding various objects for use by a bedridden person.

The specialized beds used in hospitals, nursing homes and convalescent facilities have side rails that can be raised to preclude a bedridden person from falling out and can be lowered to permit the person to exit when necessary. Although articles such as glasses or cups of fluid and other items desired by a bedridden person may be placed on a table or stand adjacent the bed, the side rails on such beds when in the raised position prevent a bedridden person, especially one who is infirm, from reaching over the rail to remove the item from the table. Thus, it is desirable to have the ability to mount such items and other sundry items at a location more convenient to such person.

The side rails on such beds have at least a pair of longitudinally extending rails fastened to slideably mounted uprights at the head and foot ends of the bed and the rails have become convenient mounting locations for a number of bed rail supported brackets. For example, in Nilson U.S. Pat. No. 3,473,772 a urinal holder has a pair of arcuate hooks conforming to the diameter of the upper bed rail supported by a respective spring so that the hook can be disposed about the upper rail, and has a lower arcuate hook adjustably carried on the rear of the holder for positioning about the adjacent lower rail. In DeLong U.S. Pat. No. 4,357,881, a tray support having a pair of arcuate hooks which mount about an upper rail carries a pivotably mounted telescoping arm having a lower arcuate hook for clamping about a lower bed rail. In Pruente et al. U.S. Pat. No. 4,432,522 a telephone support has an arcuate hook which snaps onto the upper bed rail and includes a downwardly extending bent hook which merely engages one of the lower rails and is held in position by capture thereof at the edge of the mattress. In Hamm U.S. Pat. No. 4,431,154 a telephone holder has an arcuate hook member for grasping the upper rail with the bottom of the holder merely abutting a pair of upright rails extending between the longitudinal rails. In Jenssen U.S. Pat. No. 3,340,826 a bed tray includes a movable arcuate hook which can mount about the upper bed rail while a downwardly extending portion of the tray merely abuts a pair of other longitudinally extending bed rails. Other known prior art wherein a bracket for clamping onto to spaced apart rails for supporting a member comprise Christine et al where a support member has an arcuate slot for clamping onto an upper rail and a lower slot for clamping about a lower rail, the support member being a dispensing rack for pourable materials. Other patents located during a prior art search conducted prior to the filing of the instant application include: Rose U.S. Pat. No. 1,219,158; Beabberl U.S. Pat. No. 4,215,840; Maffei U.S. Pat. No. 4,410,158; Winckler U.S. Pat. No. 4,831,673; and Waddell et al U.S. Pat. No. 4,836,113, which except for Babberl have various means for attaching objects to a bed.

The limitations of the known prior art are apparent. Except for Nilson and DeLong none of the known prior art has an adjustable feature for taking into consideration the varying space between the longitudinally extending rails of the bed side rails. Each of these patents, however, are limited to the mounting of specific devices such as either a urinal or a tray holder. Additionally, the adjustable feature in each of these patents requires a wingnut to be tightened to position the member properly, and both require the use of metallic material thereby resulting in relatively expensive manufacturing costs.

SUMMARY OF THE INVENTION

Consequently, it is a primary object of the present invention to provide a mounting bracket which is readily attached to the side rails of a bed for holding a multitude of objects so that the objects are assessable to a bedridden person.

It is another object of the present invention to provide a universal mounting bracket adapted to be attached between a pair of spaced apart longitudinally extending rails of the side rail of hospital beds and the like having various spacing between said rails, the bracket carrying an item supporting shelf.

It is a further object of the present invention to provide an inexpensive universal mounting bracket, for attachment to a pair of spaced apart longitudinally extending rails of the side rails of hospital beds and the like, and of wheel chairs and walkers used by disabled persons, the bracket having a first clamp for grasping an upper one of the rails and an adjustably mounted second clap for securely grasping a lower one of the rails, and carrying selectively removable shelves that hold various items.

Accordingly, the present invention provides a mounting bracket having a housing including an arcuate clamping slot at the top thereof for clamping about a first longitudinally extending rail of a bed side rail, at least a portion of the interior of the housing being hollow and having an opening at the bottom thereof for receiving an arm adjustably positionable at one end within a slideway in the hollow and having an arcuate clamping slot disposed at the other end for clamping about a second longitudinally extending rail of the bed side rail spaced below the first rail. The housing includes a wall facing away from the side rail having a groove forming a slideway for securely receiving a removable shelf adapted to hold various items for ready access by a person within the bed.

In the preferred form of the invention the clamping slot on the arm opens toward the bed rail so that the mounting bracket may be clamped about the upper rail and pivoted so that the arm clamping slot may readily receive the lower rail. The arm adjacent the upper end includes a protuberance for locking it within the housing, while a multiplicity of detents spaced along the arm cooperate with a wall of the housing facing the opening to provide positive stops for the arm in selected positions. In the preferred embodiment the shelf is configured for holding a drinking cup or glass. Additionally, the mounting bracket may be readily mounted on the rails of a wheel chair or a walker for holding drinking cups or the like. The mounting bracket may be readily constructed by molding all of the elements thereof from plastic so that manufacturing costs may be minimized.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
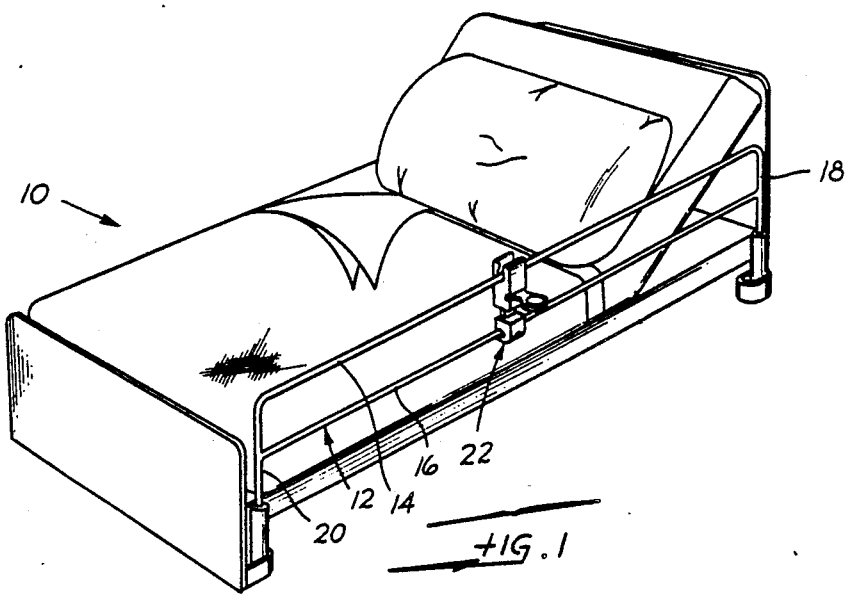
FIG. 1 is a perspective view of a bed side rail mounting bracket constructed in accordance with the principles of the present invention, the bracket being mounted on the side rail of a hospital type bed.

Referring now to the drawings, FIG. 1 illustrates a hospital or similar type bed 10 which typically has a pair of side rails 12, only one of which is illustrated, the side rails having at least a pair of longitudinally extending rails 14, 16 spaced apart one above the other. The rails 14, 16 are integral with or otherwise fixedly attached to uprights 18, 20 at the head end and foot end of the bed respectively, and these uprights are conventionally slidably mounted for vertical movement so that the side rails 12 may be positioned in a raised position, as illustrated, to permit a patient from accidentally falling out of the bed, or a lowered position so that the patient may exit the bed. Since bedridden patients, especially those who may be infirm, find it difficult to reach over to a night stand or the like (not illustrated) to obtain a required article such as a cup of water, the present invention provides a mounting bracket, generally indicated at 22, for holding such an item conveniently located for the patient.

Figure 2:
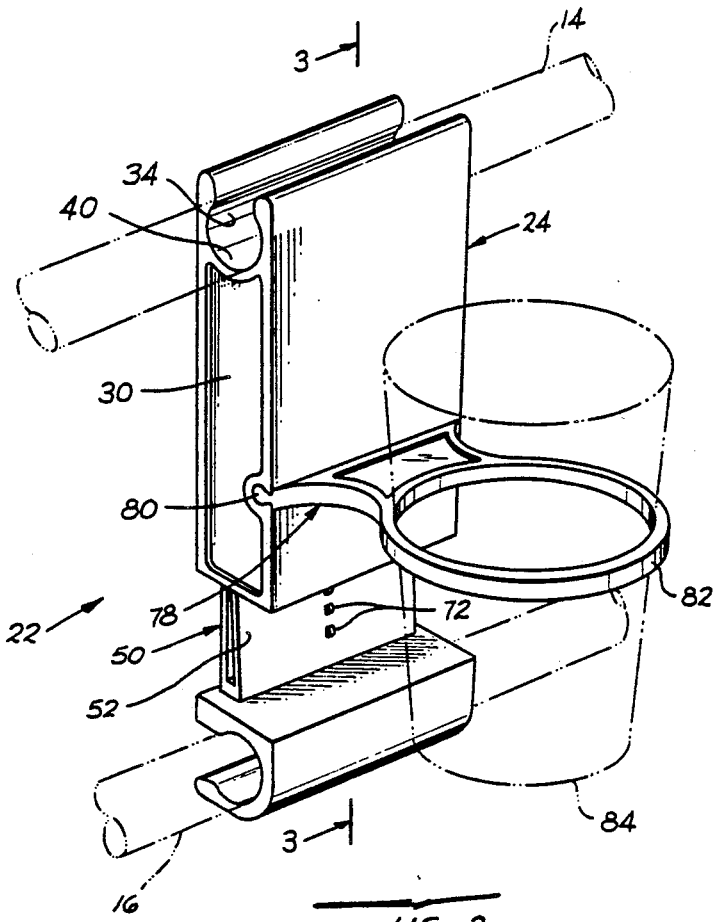
FIG. 2 is an enlarged perspective view of the mounting bracket illustrating the preferred form of shelf and depicting the side rail longitudinal rails and a drinking cup in phantom.
Figure 3:
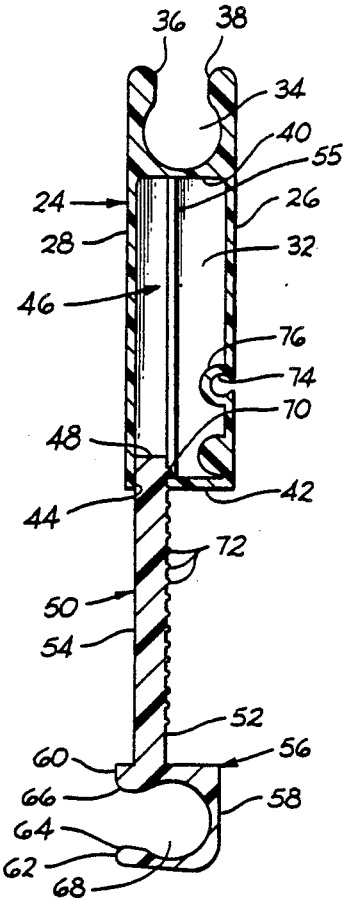
FIG. 3 is a fragmentary cross sectional view taken substantially along line 3-3 of FIG. 2 with the shelf removed for clarity of presentation.

As best illustrated in FIGS. 2 and 3, the mounting bracket 22 of the present invention comprises a housing 24 preferably in the general form of a rectangular block having front and rear walls 26, 28 respectively connected together by integral side walls 30, 32. Formed at the upper end of the housing is an arcuate slot 34 which opens at the top between spaced limbs 36, 38 extending from the front and rear walls 26, 28 respectively, the upper ends of the limbs being adapted for snugly receiving the rail 14 therebetween while the remainder of the slot formed by the limbs and the top wall 40 of the housing has a substantially circular configuration corresponding to the cross sectional shape of the rail. The housing 24 is preferably molded from a synthetic plastic material such as polystyrene or similar material and the limbs 36, 38, which are spaced apart by an amount smaller than the diameter of the slot 34 may thus flex to permit the rail 14 to enter into the slot 34.

Formed at the bottom end of the housing 24 is a bottom wall 42 having a substantially rectangular shaped slot 44 opening into a substantially hollow interior 46 of the housing for reasons hereinafter made clear. Thus, the housing preferably is molded as two parts such that half of the front, rear, top and bottom walls 26, 28, 40, and 42 respectively and thus half of the slot 34, together with one side wall 30 or 32 is molded as a unit with a core forming the respective half of the hollow, and the two halves are subsequently secured together by bonding or the like. To ensure a substantial clamping surface the slot 34 extends the entire width of the front and rear walls 26, 28, and the slot extends at least between the interior surfaces of the side walls 30, 32.

Received within the hollow 46 of the housing 24 through the slot 44 is the upper end 48 of an elongated arm 50 preferably having a width in the longitudinal direction of the rails 14, 16, substantially equal to the length of the slot 44, and having a thickness between front and rear walls 52, 54 substantially equal to the width of the slot 44. Preferably, as illustrated, the slot 44 extends from the rear wall 28 to a spaced edge of the bottom wall 42, and a rib 55 extends from each side wall 30, 32 at the location of the edge. Thus, the rear wall 28 together with the ribs 55 provide a slideway for the arm 50. The arm 50 is also molded from synthetic plastic material, preferably the same material as the housing 24, and is formed with an enlarged body 56 at its lower end. The body 56 preferably has a width substantially equal to that of the front and rear walls 24, 26 and has a depth between the surface of a front wall 58 and rear surfaces 60, 62 substantially equal to that of the housing 24 between the outer surfaces of the front and rear walls 26, 28, the surfaces 60, 62 being the free ends of respective spaced apart limbs 64, 66. The body 56 has an arcuate slot 68 similar in shape and size to the slot 34 but facing rearwardly. Thus, the limbs 64, 66 form the open end of the slot and are adapted to snugly receive the rail 16 while the remainder of the slot 68 has a substantially circular configuration corresponding to the cross sectional configuration of the rail 16, the limbs flexing to permit the rail to be received within the circular portion.

Adjacent the upper end 48 of the arm 50, preferably at the front 52, is a protuberance 70, illustrated in FIG. 3, which acts as a stop and extends so that the distance from the rear wall 54 to the front of the protuberance 70 is greater than the width of the slot 44. Thus, once the arm is positioned within the hollow 46 of the housing 24 and the two halves of the housing are secured together, the arm 50 is locked within the housing and cannot readily be pulled out through the slot 44. Also formed on the arm 50, preferably on the front wall 52, is a multiplicity of small teeth or ribs 72 which act as detents to provide positive stopping locations for the arm as it is slidably extended from the interior of the housing 24. These detents 72 extend slightly beyond the front wall 52 and preferably are spaced apart slightly more than the thickness of the bottom wall of the housing 24 so that a substantial number of closely spaced apart positive stops are provided as the arm 50 is adjusted so that the spacing between the rail receiving arcuate slots 34 and 68 may accommodate varying spacings between rails 14 and 16 of the various hospital type beds in service.

Formed in and extending the width of the front wall 26 of the housing 24 is an elongated groove 74 which is readily molded within an internally extending bulbous ridge 76 of the wall 26. The groove 74 preferably has a circular cross section for ease of manufacture and opens at the front. A shelf 78 having an insert in the form of an elongated rod shaped bulbous rear end 80 is adapted to be slidably received within the groove74 in mortise and tenon fashion. The remainder of the shelf may be of any convenient configuration for supporting various items, but in the preferred embodiment the shelf includes an annular or ring portion 82 extending forwardly from the body of the shelf remote from the end 80, the ring 82 being adapted to receive a drinking cup 84 or the like. Thus, a patient or other bedridden person may readily remove the cup 84 and partake of its contents. Shelves having other forms for holding toilet articles and other items may readily be substituted for the cup holding shelf disclosed, or shelves holding combinations of such items may be utilized as long as the shelf has a connecting means for mating with the slot 74. Alternatively, the housing 24 may have a male member received within a female member of the shelf, but that would require that the shelf be thicker thereby increasing the cost of the various shelves.

To use the mounting bracket of the present invention, the housing 24 is positioned adjacent the upper rail 14 and pushed so that the rail 14 is received within the slot 34. The housing is then pivoted downwardly and the arm 50 is adjusted to position the slot 68 in the body 56 at the end of the arm adjacent the lower rail 16. The arm is then merely pushed toward the rail until the rail 16 is received within the slot 68. The shelf may be pre-attached to the housing 24 or may be slidably positioned thereon after the mounting bracket has been connected to the rails. When the side rail 12 is lowered the bracket too is lowered and need not be removed except when desired. Because of the construction of the bracket of the present invention, not only can it be mounted on a bed having side rails, but it can also be mounted on the rails of a wheel chair and on the rails of a walker used by disabled persons. Thus, it has a great degree of versatility and the present invention is not limited to hospital beds but encompasses other devices having side rails with spaced apart upper and lower rails.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A mounting bracket for attachment to devices having side rails including an upper and a lower longitudinally extending rail, said bracket comprising a housing including top, bottom, front and rear walls, a first open end clamping slot formed by said top wall and portions of said front and rear walls for receiving and clamping about said upper rail, a hollow formed within said housing, an opening formed in said bottom wall communicating with said hollow, an arm having an upper end and a lower end, the upper end of said arm extending through said opening into said hollow for telescopic movement of said arm relative to said housing, a body member formed at the lower end of said arm, said body member being larger than said opening so as to be precluded from entry into said body member, a second open end clamping slot formed in said body member, said second slot opening rearwardly relative to said housing and adapted for receiving and clamping about said lower rail when said arm is adjustably positioned, a shelf for holding selected items for use by a bedridden or other disabled person, and cooperative means formed in said front wall and said shelf for securely connecting said shelf to said housing selectively.

2. A mounting bracket as recited in claim 1, wherein each of said slots is defined by a pair of spaced apart limbs at the open end and an arcuate section, said arcuate section having a cross sectional configuration substantially equal to a sector of a circle, said sector being greater than half of the circle, the space between said limbs being less than the diameter of said circle.

3. A mounting bracket as recited in claim 1, wherein said arm includes stop means for securing said arm from withdrawal from said housing.

4. A mounting bracket as recited in claim 3, wherein said stop means comprises a protuberance formed adjacent said upper end of said arm, said protuberance abutting the bottom wall of said housing to preclude withdrawal of said arm out said opening.

5. A mounting bracket as recited in claim 1, wherein said arm includes a multiplicity of detents forming positive stops for said arm relative to said housing, each detent comprising a tooth for engaging said bottom wall as said arm is moved through said opening relative to said bottom wall.

6. A mounting bracket as recited in claim 1, including means within said housing defining a slideway for slidably guiding the movement of said arm.

7. A mounting bracket as recited in claim 1, wherein said cooperative means comprises a groove formed in said front wall, and an insert formed on a facing edge of said shelf adapted to be slidably received within said groove.

8. A mounting bracket as recited in claim 7, wherein said shelf includes an annular portion for holding a drinking cup or the like.

9. A mounting bracket as recited in claim 6, wherein each of said slots is defined by a pair of spaced apart limbs at the open end and an arcuate section, said arcuate section having a cross sectional configuration substantially equal to a sector of a circle, said sector being greater than half of the circle, the space between said limbs being less than the diameter of said circle.

10. A mounting bracket as recited in claim 9, wherein said arm includes stop means for securing said arm from withdrawal from said housing.

11. A mounting bracket as recited in claim 10, wherein said stop means comprises a protuberance formed adjacent said upper end of said arm, said protuberance abutting the bottom wall of said housing to preclude withdrawal of said arm out said opening.

12. A mounting bracket as recited in claim 6, wherein said arm includes a multiplicity of detents forming positive stops for said arm relative to said housing, each detent comprising a tooth for engaging said bottom wall as said arm is moved through said opening relative to said bottom wall.

13. A mounting bracket as recited in claim 12, wherein said arm includes stop means for securing said arm from withdrawal from said housing.

14. A mounting bracket as recited in claim 13, wherein said stop means comprises a protuberance formed adjacent said upper end of said arm, said protuberance abutting the bottom wall of said housing to preclude withdrawal of said arm out said opening.

15. A mounting bracket as recited in claim 14, wherein each of said slots is defined by a pair of spaced apart limbs at the open end and an arcuate section, said arcuate section having a cross sectional configuration substantially equal to a sector of a circle, said sector being greater than half of the circle, the space in-between said limbs being less than the diameter of said circle.

16. A mounting bracket as recited in claim 15, wherein said cooperative means comprises a groove formed in said front wall, and an insert formed on said shelf adapted to be slidably received within said groove.

17. A mounting bracket as recited in claim 16, wherein said shelf includes an annular portion for holding a drinking cup or the like.

* * * * *